US005236137A

United States Patent [19]

Coogan

[11] Patent Number: 5,236,137

[45] Date of Patent: Aug. 17, 1993

[54] APPARATUS AND METHOD FOR GARBAGE DISPOSAL CLEANING

[76] Inventor: Charles C. Coogan, 5047 N. A1A, Apartment 1003, Fort Pierce, Fla. 34949

[21] Appl. No.: 890,075

[22] Filed: May 29, 1992

[51] Int. Cl.[5] ..... B02C 23/36

[52] U.S. Cl. ..... 241/30; 241/46.014; 241/46.04; 4/681; 4/683; 134/8; 134/22.11; 137/247.13; 137/247.51; 251/205; 251/327

[58] Field of Search ..... 251/326, 327, 205; 241/30, 46.013–46.017, 46.02, 46.04; 137/247.13, 247.41, 247.51; 134/8, 22.1, 22.11; 4/681–685

[56] References Cited

U.S. PATENT DOCUMENTS

| | | | |
|---|---|---|---|
| 400,128 | 3/1889 | Shepherd . | |
| 758,040 | 4/1904 | Angell | 137/247.13 X |
| 1,147,754 | 7/1915 | Schultz | 137/247.41 X |
| 1,666,583 | 4/1928 | Rost | 4/682 |
| 2,286,520 | 6/1942 | Tranbarger | 241/46.014 |
| 2,580,575 | 1/1952 | Muckler | 4/683 |
| 3,314,082 | 4/1967 | Minella | 4/682 |
| 3,680,829 | 8/1972 | McCoy | 241/46.013 |
| 3,823,879 | 7/1974 | Johnson | 241/46.013 X |
| 4,194,721 | 3/1980 | Nachtigahl . | |
| 4,523,339 | 6/1985 | Lavoic | 251/326 X |
| 4,637,079 | 1/1987 | Hodge . | |
| 4,643,226 | 2/1987 | Bälz | 251/326 X |
| 4,763,366 | 8/1988 | Moreland | 4/683 X |
| 5,056,544 | 10/1991 | Stevens . | |
| 5,127,587 | 7/1992 | Johnson | 241/46.013 |

FOREIGN PATENT DOCUMENTS

| | | | |
|---|---|---|---|
| 155199 | 5/1982 | German Democratic Rep. | 251/326 |
| 173679 | 10/1982 | Japan | 251/326 |
| 106156 | 8/1924 | Switzerland | 4/682 |
| 108440 | 1/1925 | Switzerland | 4/682 |
| 127741 | 9/1928 | Switzerland | 4/682 |
| 767441 | 10/1980 | U.S.S.R. | 251/326 |
| 1216208 | 12/1970 | United Kingdom | 4/682 |

*Primary Examiner*—Timothy V. Eley
*Assistant Examiner*—Frances Chin
*Attorney, Agent, or Firm*—Richard C. Litman

[57] ABSTRACT

An apparatus and method for cleaning and flushing a conventional garbage disposal unit. A flow restricting valve replaces a conventional valve in the water seal trap in a kitchen drain line. The flow restricting valve is actuated by a pull-push plunger from outside the pipe. To clean the garbage disposal, the valve is closed and water back flows into the disposal unit for cleaning. When the valve is opened the garbage disposal unit can be flushed. Accordingly, the garbage disposal unit is easily cleaned and flushed, eliminating undesirable odors, without the need for a plumber's intervention.

10 Claims, 2 Drawing Sheets

APPARATUS AND METHOD FOR GARBAGE DISPOSAL CLEANING

BACKGROUND OF THE INVENTION

1. Field of the Invention

This invention relates to an apparatus and method for cleaning a kitchen garbage disposal. More specifically, the invention relates to a flow restricting valve used in a kitchen sink drain line to allow for the cleaning of the garbage disposal.

2. Description of the Prior Art

Gate valves have been in use for many years. C. H. Shepherd patented a gate valve in U.S. Pat. No. 400,128 on Mar. 26, 1889, which includes a slidable plunger which is actuated by screwthreads to move a gate into a blocking position within a conduit.

Improvements on the gate valve concept have included U.S. Pat. No. 4,194,721 issued on Mar. 25, 1980, to Carsten Nachtigahl, for a plumbing test fitting for waste or vent pipes and stacks extending between adjacent floors of a building, having a closure plate adapted to be slidably fitted between a pair of spaced adjacent ends of a pair of pipes. Gate valves such as these are positive shutoff valves, and are usually used for non-permanent applications such as temporarily sealing off sections of pipe in testing for leakage. Generally gate valves, having a worm gear, would not be effective for the instant purpose in that gate valves would leak over time from the worm gear being turned on and off.

U.S. Pat. No. 4,637,079 issued on Jan. 20, 1987, to Robert R. Hodge, for a back flow preventing attachment for toilets, discloses a slidable valve for mounting between a standard soil pipe mounting flange and drain horn of a standard toilet bowl. Hodge's valve, being designed to prevent any backflow, does not provide for any controlled leakage as does the instant invention.

On Oct. 15, 1991, Charles F. Stevens received U.S. Pat. No. 5,056,544 for a recreational vehicle remotely controlled tank drain valve and flushing method. This patent further illustrates a valve which provides a full shutoff in the closed position and would be ineffective for the present purpose.

None of these patents, or any other inventions known, taken singly or in combination, show the concept of the present invention which is a flow restricting valve for installation in a kitchen sink drain line to allow for cleaning of the garbage disposal, while permitting a small amount of water to flow through the drain line.

SUMMARY OF THE INVENTION

By the present invention, an easily accessible flow restricting valve is disclosed for assisting in the cleansing operation of a kitchen garbage disposal. By depressing a plunger in the valve the flow of tap water or a cleaning fluid through the drain line is decreased or restricted so that the liquid will back up into the disposal unit where it is used in the cleansing operation. Accordingly, it is an object, advantage and feature of the invention to provide an improved valve for placement in a kitchen sink drain line to allow for the cleaning of a conventional sink-mounted garbage disposal unit.

It is a further object, advantage and feature of this invention to allow for the easy and effective removal of unwanted odors from such garbage disposals.

It is a further object, advantage and feature of the invention to provide for an easy and effective way of cleaning said garbage disposals without the need for a plumber.

Still a further object, advantage and feature of the invention is to provide a valve which allows a small amount of water to flow through the kitchen drain line while cleaning the garbage disposal.

Another object, advantage and feature of the invention is to provide a valve and trap replacement for a conventional sink trap.

Another object, advantage and feature of the invention is to provide for a valve kit for insertion into an existing conventional sink trap.

Still a further object, advantage and feature of the invention is to provide for a garbage disposal cleaning device of lightweight yet durable construction.

A further object, advantage and feature of the invention is to provide for a cleaning device for garbage disposals that can be remotely actuated.

Lastly, it is an object, advantage and feature of the invention to provide for a novel method of cleaning a garbage disposal utilizing the improved valve of the invention.

A general goal is to provide improved elements and arrangements thereof in an apparatus for the purposes described which is inexpensive, dependable, and fully effective in accomplishing its intended purposes.

It is submitted that the present invention meets or exceeds all the above objects and goals. Upon further study of the drawings, specification and appended claims, further objects and advantages of this invention will become apparent to those skilled in the art.

BRIEF DESCRIPTION OF THE DRAWINGS

Like reference numerals on the various drawings refer to like components throughout the description below.

DETAILED DESCRIPTION OF THE PREFERRED EMBODIMENT

Figure 1:
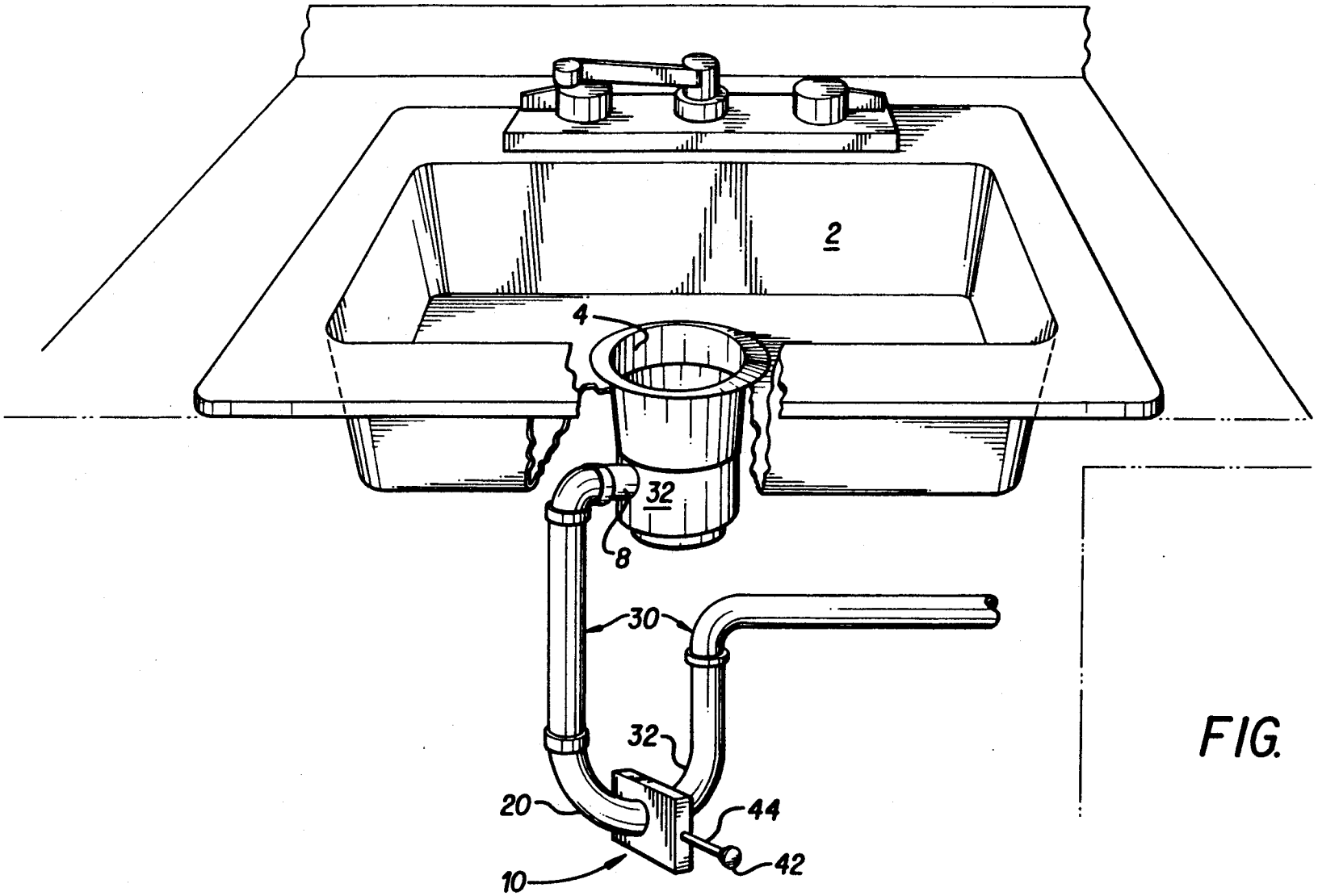
FIG. 1 is an environmental perspective view showing a kitchen sink and garbage disposal including the kitchen sink drain line with the flow restricting valve of the invention therein.

FIG. 1 shows conventional sink 2 with drain 4 and garbage disposal 31. Flow restricting valve 10 is shown in kitchen sink drain line 30 at the location of water seal "J" trap 20.

Flow restricting valve 10 assists in a cleansing operation to clean a kitchen garbage disposal 31. Sliding plunger 40 in valve 10 to the right (as in FIG. 3) decreases or restricts the flow of liquid through drain line 30 so that if liquid continues to flow at the same rate from sink 2 into drain line 30, the liquid will back up into disposal unit 31. Valve 10 allows the garbage disposal to be filled with water or other suitable cleaning fluid, which when agitated by the disposal unit 31, will wash the disposal unit. Valve 10 is designed to decrease or restrict the flow of liquid in drain line 30, when actuated, but not completely stop the flow of liquid. When valve 10 is in a closed position, liquid can continue to drain past the valve at a slower rate than when valve 10 is completely open. Liquid will then back up into disposal unit 31 while continuing to flow at the slower rate so the kitchen sink will never overflow.

Valve 10 may be provided as a kit for installation in an existing water seal trap or may be provided as an integral part of a replacement water seal trap for a conventional 1½ inch diameter sink trap. Valve 10 is mounted in the "J" bend 32 of trap 20 and becomes part of the trap. The normal "J" bend 32 measures 3½ inches from center to center of the descending and ascending pipe portions. Valve 10, when installed in "J" bend 32, still allows for the same 3½ inch measure from center to center. Valve 10 has no parts that will corrode while in trap seal 20, and is preferably constructed of lightweight, polyvinyl chloride (PVC) material. The size of valve 10, and approximate weight of eight ounces, allows it to be installed in any kitchen sink drain line 30, without requiring modification of drain line 30 to accommodate valve 10. A gate valve would not have the same benefit in that it would typically weigh at least one and three quarters pounds and would be too heavy for installation in a kitchen sink drain line 30 unless substantial modifications were made. In particular, the bending moment imposed on typical outlet 8 of typical garbage disposal 31 would require reinforcement. Hence, valve 10 provides for simple installation.

Figure 4:
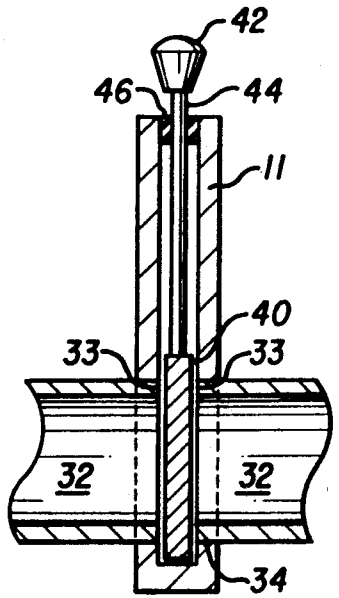
FIG. 4 is a section view taken along line 4—4 of FIG. 2 showing mating of the valve sides and "J" trap.
Figure 3:
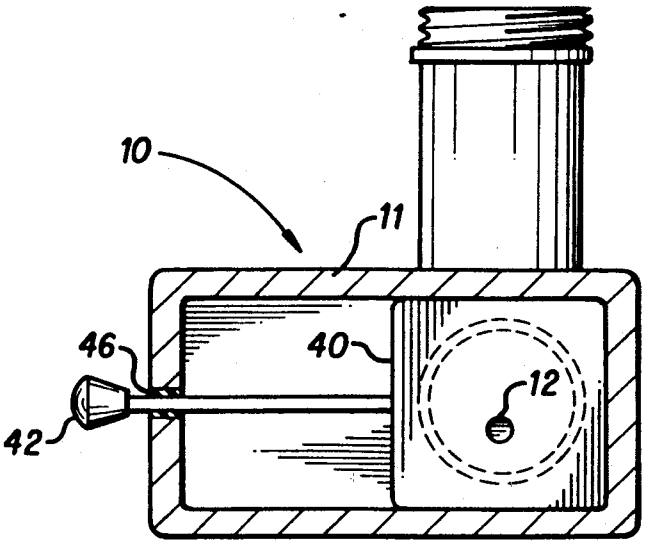
FIG. 3 is a section view taken along line 3—3 of FIG. 2, with the flow restricting valve and its component parts shown in the closed position.
Figure 2:
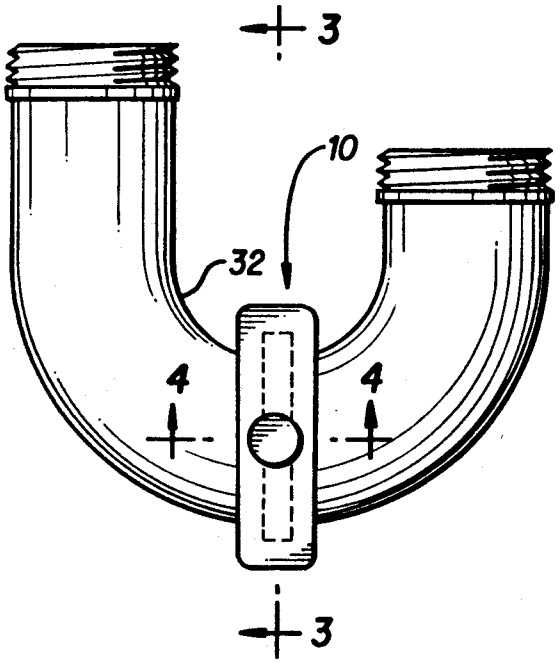
FIG. 2 is an elevation view of the flow restricting valve installed on the "J" trap section of the drain line.

Valve 10 comprises a hollow rectangular housing having top, bottom, front, back, left, and right side walls 11 (FIGS. 3 and 4). Enclosed within the housing is a substantially square sliding plunger 40 which is reciprocated by plunger knob 42 and plunger rod 44, and sealed by conventional packing gland 46. The plunger rod is preferably made from chrome or brass and is used to operate valve 10 to selectively restrict the drainage in line 30 downstream from garbage disposal unit 31. When the plunger 40 is depressed (slid to the right in FIG. 3), water inside line 30 backs up into disposal unit 31 (FIG. 1). Disposal unit 31 is then turned on to create violent agitation of the liquid contained therein. The disposal unit 31 can then be rinsed with soapy water or deodorant or other suitable fluids for cleaning, and, when cleaned, plunger 40 would be pulled outward permitting the disposal unit 32 to flush.

It should be noted that plunger rod 44 can be replaced by other suitable actuation means, accessible either from the outside of J bend 32 or next to the kitchen sink or garbage disposal switch. Other mechanical, electronic, or computerized components can be employed as desired to actuate the selective control of valve 10. Valve 10 may be formed unitarily with an otherwise conventional PVC drain trap or may be formed as a kit for installation into an existing drain trap. In either case valve 10, being installed in trap seal 20, as a replacement for the conventional sink trap, prevents sewer gas and odor from leaking into the house. If valve 10 were to leak, it would be noticed by leaking water below the trap 20.

When closed, valve 10 allows a small amount of water to flow through drain line 30. If a kitchen faucet should leak when valve 10 is closed, the kitchen sink will not overflow because water will drain out slowly through valve 10. Plunger 40 has a pilot opening 12 therein which allows water to flow through plunger 40 when closed. Opening 12 in the preferred embodiment is about one quarter inch in diameter. Further, in the preferred embodiment, plunger 40 is about one and seven eighths inches square and has a thickness of about three sixteenths of an inch. At one end it is connected to plunger arm 44. The fluid filled gap in which plunger 40 rests is approximately one quarter inch thick in the preferred embodiment. Plunger 40, being only three sixteenths of an inch thick, allows a one sixteenth of an inch space 52 for water flow around the edges of the plunger as well, as shown in FIG. 4. Likewise, the preferred embodiment provides a plunger one and seven eighths inches square, fitting within hollow space of valve 10 which is slightly larger thus promoting easy sliding and allowing for further water flow around the plunger 40. In case pilot hole 12 should become clogged, water could still slowly drain through the closed valve. The main purpose of this controlled leakage is to prevent overflow of the sink in case of a leaking faucet when the valve might be accidently left in the closed position.

In operation, a household resident desirous of cleaning garbage disposal unit 31, thereby removing the cause of unwanted odors, would actuate valve 10 by operating plunger 40 which is accessible from the exterior of J bend 32. By depressing plunger 40, valve 10 would close. The user would then turn on the sink faucet to fill the garbage disposal unit 31 with water. Other cleaning agents or deodorizing agents can be used. Garbage disposal unit 31 would be operated. Once the desired cleaning is completed, plunger 40 would be pulled outward, opening valve 10. As is seen, a garbage disposal unit 31 can be quickly cleaned without the need for a plumber to manually access the garbage disposal unit 31. Flow restricting valve 10 is positioned at the appropriate location for such a valve, in that a fitting or valve is not typically used downstream of a water seal trap in a sanitary drain because the seal on the valve can dry and allow sewer gas and odor to leak into the house. By having valve 10 within trap 20, these hazards are avoided. Valve 10 is ideally suited for a kitchen sink drain line 30 and will not totally obstruct water flow or cause stoppage.

It would be possible to form the entire valve unit drain trap assembly as a single molded unit. The installation of such a unit would be simply a matter of replacing the old drain trap with the new one. If one desired to refit an existing drain trap it would be possible to create a vertical cut through the bottom of the trap pipe 32 creating edges as at 33 in FIG. 4. The cut pipe portions 32 could then be spread to slip valve 10 therebetween till circular holes 34 in the side walls of hollow housing 11 are aligned with the circular ends of cut pipe. The pipe ends are then coated with solvent or sealer and pressed into the circular holes to a depth just shy of interfering with plunger 40 (about ¼ inch).

As is apparent from the above description, the apparatus and method described herein for cleaning and flushing a conventional sink-mounted garbage disposal unit, wherein a flow restricting valve is actuated by a plunger to accomplish the cleaning and flushing, is the preferred embodiment of the invention. Other embodiments of the invention are included within the scope of the claims appended hereto.

I claim:

1. A method for cleaning a conventional garbage disposal unit mounted below a sink and above a kitchen drain line, comprising the steps of:

providing a flow restricting valve in the kitchen drain line, said valve having a hollow housing with a slidable plunger in said housing, said plunger having an opening therein;

sliding the plunger from an open position, enabling fluid to flow unrestricted from said sink through said garbage disposal unit to said kitchen drain line, to a closed position within the valve, said opening in said plunger enabling restricted flow of said fluid from said sink through said garbage disposal unit to said kitchen drain line, so that the fluid will back up into the garbage disposal unit;

providing a cleansing fluid by pouring the cleansing fluid down the kitchen drain line;

turning on the garbage disposal unit to facilitate the cleaning thereof; and sliding the plunger to an open position within the valve so that the fluid including the cleansing fluid will drain from the garbage disposal unit and flush past the restricting valve.

2. In an apparatus for cleaning a garbage disposal unit connected to a sink and to a drain line, said drain line including a water seal U trap, the improvement comprising:

a flow restricting valve enabling cleaning said garbage disposal unit, including a hollow housing transversely disposed in said drain line below said garbage disposal unit, said housing having top, bottom, front, left and right sidewalls defining an inside perimeter therein, said left and right sidewalls having openings therethrough enabling water and disposal products from said sink and said garbage disposal unit to pass through said drain line, and a slidable plunger housed within said housing and movable between an open position and a closed position transversely of said drain line, said plunger including a plunger rod connected to said plunger and extending through said front wall, a knob mounted on said plunger rod externally of said front wall, and an opening disposed centrally on said plunger, said opening being of a size to restrict the flow of water when said plunger is in the closed position, whereby said flow of water when restricted backs up into said garbage disposal unit, enabling cleaning materials added to said flow of water to circulate within said garbage disposal unit during operation of said garbage disposal unit, thereby enabling cleaning of said garbage disposal unit.

3. In an apparatus for cleaning a garbage disposal unit as in claim 2, said hollow housing being disposed within and transversely to said water seal U trap.

4. In an apparatus for cleaning a garbage disposal unit as in claim 1, wherein said plunger has a perimeter of a size less than the diameter of said drain line, whereby fluid can flow around said plunger when said plunger is in a closed position.

5. In an apparatus for cleaning a garbage disposal unit as in claim 2, wherein said plunger is actuated from a remote location.

6. In an apparatus for cleaning a garbage disposal unit as in claim 2, wherein said housing is rectangular and said plunger is substantially square.

7. In an apparatus for cleaning a garbage disposal unit as in claim 2, wherein at least said hollow housing and said plunger are constructed of PVC material.

8. In an apparatus for cleaning a garbage disposal unit as in claim 2, wherein said valve is constructed of lightweight material.

9. In an apparatus for cleaning a garbage disposal unit as in claim 2, wherein said plunger has a perimeter of a size less than said inside perimeter of said housing, whereby fluid can flow around said plunger when said plunger is in said closed position.

10. In an apparatus for cleaning a garbage disposal unit as in claim 9, wherein said housing is rectangular and said plunger is square.

* * * * *